175-48
5/13/86 OR 4,588,035

United States Patent [19]
Van Gils et al.

[11] Patent Number: 4,588,035
[45] Date of Patent: May 13, 1986

[54] DOWN HOLE BLOW OUT PREVENTER AND METHOD OF USE

[75] Inventors: Adrianus W. Van Gils, Loosdrecht; Abraham V. D. Boogaart, Almere, both of Netherlands

[73] Assignee: I I. E. Innovation Enterprise Ltd., Switzerland

[21] Appl. No.: 608,867

[22] Filed: May 10, 1984

Related U.S. Application Data

[63] Continuation-in-part of Ser. No. 463,674, Feb. 4, 1983, abandoned.

[51] Int. Cl.[4] ..... E21B 33/127
[52] U.S. Cl. ..... 175/48; 166/187; 166/188; 166/325; 166/373
[58] Field of Search ..... 166/188, 374, 325, 187, 166/244 R, 65.1, 330, 332, 373; 175/65, 317, 318, 242, 38, 48; 285/381; 403/273

[56] References Cited

U.S. PATENT DOCUMENTS

| | | | |
|---|---|---|---|
| 3,351,349 | 11/1967 | Chenoweth | 166/187 X |
| 3,908,769 | 9/1975 | Schuyf et al. | 175/48 |
| 3,941,190 | 3/1976 | Conover | 166/187 |
| 4,367,794 | 1/1983 | Bednar et al. | 166/187 X |

*Primary Examiner*—James A. Leppink
*Assistant Examiner*—Matthew Smith
*Attorney, Agent, or Firm*—Fulwider Patton, Rieber Lee & Utecht

[57] ABSTRACT

A down hole blow out preventer which can be installed at the lower end of a drill string as close as possible to the drill bit and which can isolate an unexpected producing zone in a bore hole from the rest of the hole by closing off the drill string at its lower end and closing off the annulus between the drill string and the wall of the bore hole by means of an inflatable packer. The packer can be operated when a predetermined pressure difference exists between the annulus and the mud column inside the tool.

17 Claims, 14 Drawing Figures

FIG. 7.
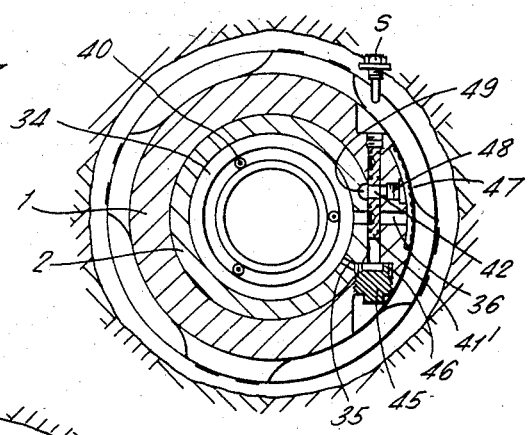
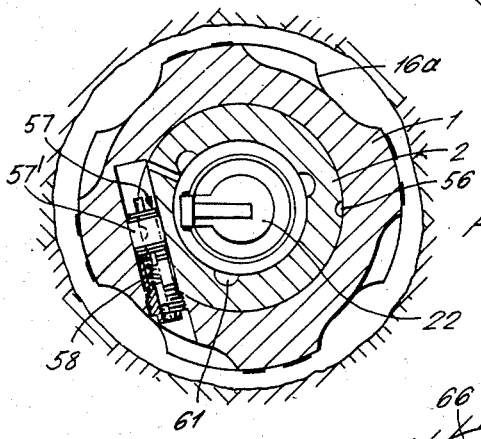
FIG. 11.
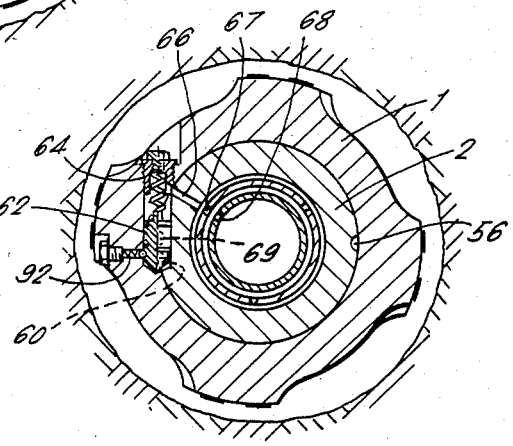
FIG. 12.

DOWN HOLE BLOW OUT PREVENTER AND METHOD OF USE

This application is a continuation-in-part of Application Ser. No. 463,674 filed on Feb. 4, 1983, now abandoned.

The invention relates to a down-hole blow-out preventer for use in drilling oil and gas wells and wells that may be drilled for recovery of geothermal energy, etc.

Surface blow-out preventers are in common use in the oil industry but so far no blow-out preventer is in commercial use which can be used successfully to block off the oil well down the drill hole and close to the drill bit.

Various proposals have been made for closing the drill hole but none has ever been used successfully commercially for various reasons.

For example U.S. Pat. Specification No. 3,908,769 shows a drill hole packer to be carried by a drill string but this packer is dependant for its operation upon a high flow rate of fluid in the reverse direction on encountering a kick. The device according to the invention works on detection of a static pressure difference.

U.S. Pat. Specifications Nos. 3,941,190 and 3,503,445 both show down hole packers but both packers are operated by tools which have to be pumped down the hole which would take several hours.

The invention provides a down hole blow out preventer comprising an elongated tubular housing having a through bore for the passage of drilling mud and means for connecting the ends of the housing into a drilling string, a packer element arranged circumferentially around the housing and inflatable into engagement with the bore hole to seal the hole, passage means extending through the housing wall for connecting the bore of the housing with the packer element to inflate the element by mud pressure from within the housing, a cylindrical valve sleeve mounted inside the housing for movement between a drilling position when the sleeve closes said passage means and an inflating position when the passage means is open, a one-way valve for closing the housing bore on the side of the sleeve to be nearer the drill bit, said valve means being operable to allow the passage of mud under pump pressure, but not allowing reverse flow of mud, said valve sleeve providing a through bore for the passage of mud, second valve means for closing the bore in the valve sleeve and means to close said second valve means automatically when pressure in the housing is reduced to a level below the pressure in the bore hole by a predetermined amount, the arrangement being such that after closing of the second valve means the pressure in the housing can be re-applied to urge the valve sleeve to its inflating position allowing the packer element to be inflated, means to prevent closure of the second valve means during running-in, a mud circulation channel extending through the housing on the side of the sleeve valve nearer the surface, means being provided to open said channel when the packer element is inflated whereby mud may be circulated through the drill string, the channel and the bore hole to increase the mud density, and means for deflating the packer element only when the mud density is sufficient to balance the pressure below the packer element.

The invention is also concerned with a method of using such a device.

A specific embodiment of a down hole blow out preventer (D.H. BOP) in accordance with the invention will now be described in detail with reference to the drawings in which:

FIG. 7 is a horizontal cross-section along line VII—VII in FIG. 6;

FIG. 11 is a horizontal cross-section along line XI—XI in FIG. 10;

FIG. 12 is a horizontal cross-section along line XII—XII in FIG. 10;

Figure 2:
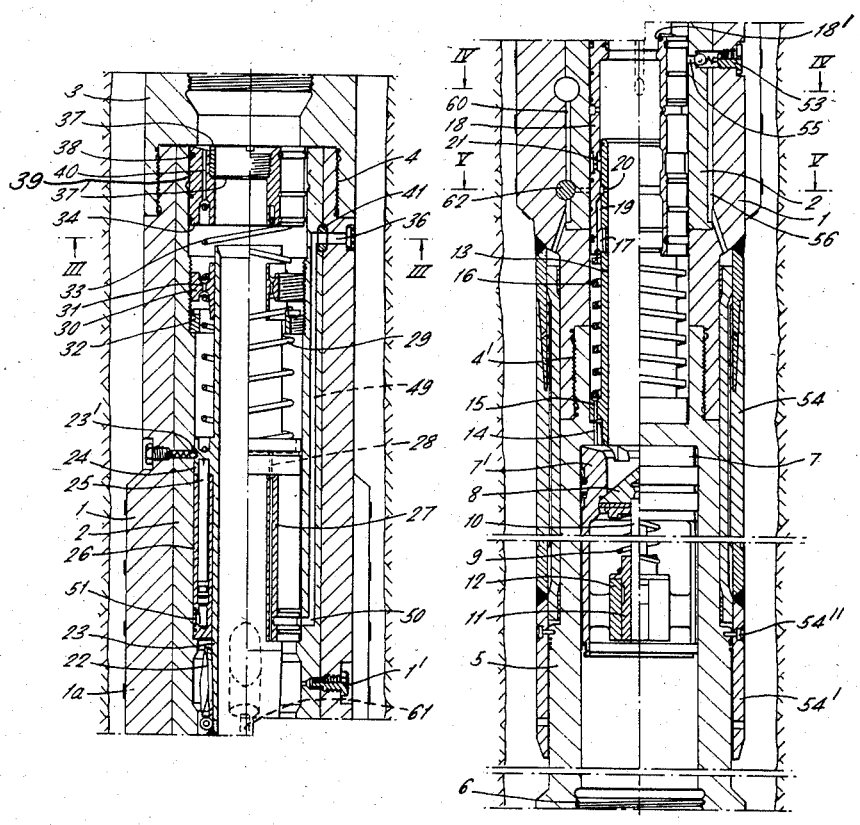
FIG. 2 is a vertical sectional view of the D.H.BOP in the running-in position.

As can be seen from FIG. 2 the D.H.BOP comprises two barrels an outer barrel 1 and an inner barrel 2.

The inside of the outer barrel 1 and the outside of the inner barrel 2 are fine machined to the required tolerances.

The various channels and holes are milled and drilled in the inner barrel 2 and after being machined the two barrels are shrunk together by undercooling of the inner barrel 2.

The position of the two barrels in relation to each other must be precise.

After shrinking the two barrels 1 and 2 together, the various radial holes can be drilled and the channels for the fill-up valve assembly 41, the grease bolt 1', the check valve 53, the circulating valve 57 and the equalising valve 62 can be drilled and machined.

The top of the outer barrel 1 is provided with an external thread 4 for connection with an API threaded substitute 3 to enable the insertion of the inner parts of the D.H.BOP from the top.

The outer barrel 1, is provided at its lower end with an internal thread 4' to connect it with a packersleeve 5.

The packersleeve 5 is at its bottom-end provided with a threaded API box connection 6 to connect it with the drilling bit.

Inside the packersleeve 5 a chamber is machined which is nearly as long as the packersleeve 5, and in which a floatvalve assembly 7 is inserted for sliding movement from a lower to an elevated position. Floatvalve assembly 7 comprises a piston-like substantially hollow body 7' in which is mounted a conical valve 8 spring-loaded by spring 9 into sealing engagement with a valve seat, formed inside body 7'. Valve 8 is fixed to valve stem 10 which is guided for sliding up and down movement in guiding sleeve 11 mounted in bushing 12 which is fixed inside body 7 by means of a spider.

A snapring sleeve 13 is inserted into the top of packersleeve 5. The top of packersleeve 5 is provided with four pressure equalising channels 15 in the snapring sleeve 13.

Around snapring sleeve 13 a helical spring 16 is inserted before a snapring 17 is pressed over the snapring sleeve 13.

A flappervalve sleeve 18 is pressed over the snapring I7 mounted around snapring sleeve 13 until it sits in a snapring recess 19.

Flappervalve sleeve 18 is provided with a friction cam 20 which can be forced over the snapring 17 until snapring 17 snaps into snapring slot 21 of flappervalve sleeve 18, by pump pressure when the flappervalve 22 is closed. The flappervalve 22 is pivotally mounted on top of flappervalve sleeve 18 and spring biased towards a closed position in which it is in sealing engagement with the top edge 18' of flappervalve sleeve 18. Closing movement is prevented by a flappervalve release sleeve 23 during circulating and drilling.

The flappervalve release sleeve 23 comprises a plunger holder 24 to which are fixed two plungers 25 which are received into bores formed in a plunger housing 26.

The plunger holder 24 and the plunger housing 26 are provided with four pressure equalising channels 27 and 28 respectively.

A helical spring 29 bears with its cover end against the top of the plunger holder 24 with its upper end against a retainer ring 30 by which the tension of spring 29 can be adjusted. The retainer ring 30 is also provided with four pressure equalising channels 31. A steel arresting ball biassed inwardly by a calibrated helical spring rests in a circumferential groove in plunger holder 24.

By stopring 32 upward movement of the plunger holder 24 is limited to keep the plungers 25 inside the plunger housing 26.

Figure 3:
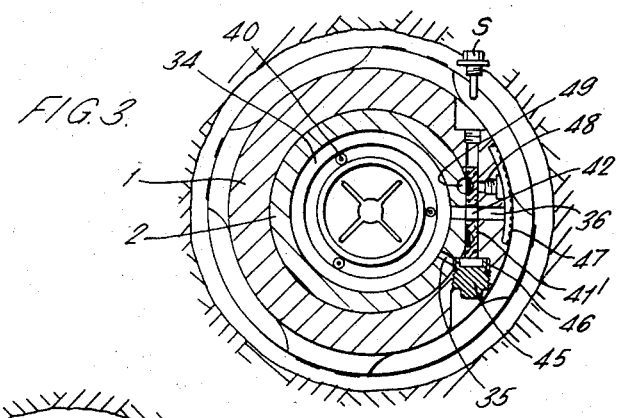
FIG. 3 is a horizontal cross-section along line III—III in FIG. 2.

Against the top of retainer ring 30 bears a helical spring 33 which bears with its other end against a shut-off sleeve 34 to keep the sleeve 34 in its highest position in which a channel 35 and a fill-up channel 36 are open (see FIG. 3).

Figure 6:
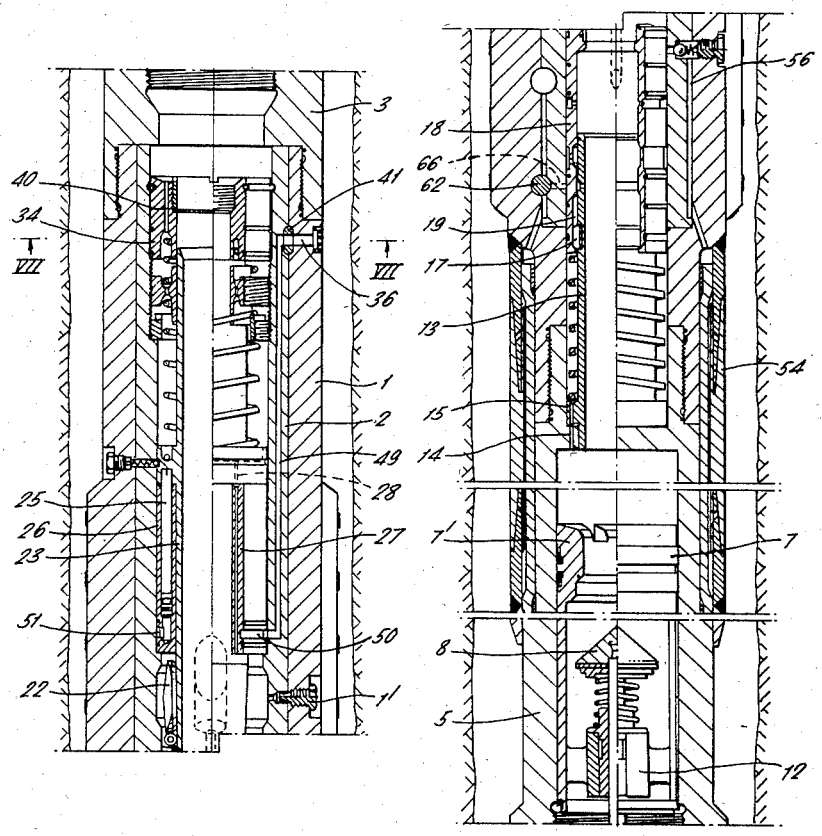
FIG. 6 shows a vertical cross-sectional view of the D.H.BOP, in drilling position.

The fill-up valve assembly 41 is shown in running-in position in FIGS. 2 and 3 and in circulating or drilling position in FIGS. 6 and 7. It comprises a gate 41' having a substantially rectangular cross-section and running in a hole 42 which hole is closed at one end by locking nut 45 having a slotted part 46 in communication with a bore 35 in the body part 2. A screen 47 covers a recess, formed in outer barrel 1 which is in communication with fill-up channel 36, and an inlet 48 which opens into flappervalve release channel 49. Channel 49 extends through inner barrel 2 and opens into circumferential groove 50 formed in plunger housing 26 and ports 51 extend from groove 50 into the plunger cylinders.

The first purpose of the fill-up valve assembly 41 is to be in open position (FIG. 3) to fill up the drill pipe when running the drill pipe into the hole and simultaneously to close off the flappervalve release channel 49 when running into the hole so that no pressure difference between the annulus and drillpipe can lift the plungers 25 and accidentally cause the flappervalve 22 to close.

Its second purpose is to close off the fill-up channel 36 once circulation or drilling has commenced. The greater pressure inside the drill pipe is propagated through channel 35 to gate 41 and moves the gate 41 to close the fill-up channel 36, against the lesser pressure in the annulus as shown in FIG. 7. When the gate 41 moves it also closes the fill up channel 36 and mud will fill the fluid lock 52.

The shut-off sleeve 34 is moved downardly when circulation is started and to increase the pressure drop an aluminium disc 37' with an orifice may be provided by means of threaded ring 37 which disc will be disintegrated during circulation. The position is shown in FIG. 6.

When the shut-off sleeve 34 moves downwardly against the tension of spring 33, the locking spring snaps into the locking groove 39 formed in the inner wall of inner barrel 2 and shuts off the channels 35 and 36. The shut-off sleeve 34 is provided with three pressure equalising channels 40.

After the shut-off sleeve 34 has moved downwardly to close channel 35 the entrapped mud in the fluid lock 52 will cause the fill-up channel 36 to be permanently closed while the flappervalve release channel 49 remains open. The plungers 25 are from now on permanently connected to and subjected to the pressure in the annulus through inlet 48 and channel 49.

Another purpose of the fill-up valve assembly is to provide the possibility to calibrate the tension of the spring loaded steel ball 23' (FIG. 2) and the spiral spring 29 before running the D.H.BOP into the hole. The spring loaded steel ball 23' is there to prevent fluttering of the flapper valve release sleeve 23 by pressures lower than the setting of the spring 29 for releasing the flapper valve 22.

To enable calibration of the spring loaded steel ball 23' and the spiral opening 29 the fill-up valve gate 41 is set in the drilling position as shown in FIG. 7 whereafter a grease pump with a pressure gauge is connected to the threaded inlet 48 leading to flapper valve release channel 49. The tension set for the spiral spring 29 depends on the maximum expected penetration rate per hour, the hole size, the depth of the hole, the pump volume and the cross sectional area of the plungers 25.

Easy to read charts can be developed for this purpose.

The required spring tension is the tension required to overbalance the greater hydrostatic head of the mud column in the annulus caused by the presence of drilled formation cuttings when the pump is stopped. A check-valve 53 is provided to allow mud to enter and to inflate the inflatable packer element 54 when the flappervalve 22 has been released and closed, and the flappervalve sleeve 18 has been pumped down to uncover the inflating port 55. This operation will be described later. Mud can then be pumped through port 55 and channel 56 into packer element 54. The check valve 53 closes and retains the mud in the inflatable packer element 54 when the pressure in the drillpipe drops.

It will be seen that the outside diameter of the outer barrel 1 has a partly enlarged diameter 1*a*, which is provided with spiral grooves 16 (FIG. 4) like an undersized solid body stabilizer.

The enlarged diameter provides protection for the packer element 54. Furthermore a steel ring 54' at the bottom end of the packer element 54 is connected to the packer sleeve 5 by means of shearpins 54''. This to protect the packer element whilst running into the hole and to withstand rotational forces when drilling. The shearpins 54'' are sheared when the packer 54 is inflated say at a pressure of 700 psi.

A shut-off valve assembly 57 is provided which is composed of a shut-off piston 57' with O-ring seals, a helical pressure spring 58 and a bushing 59 with a thread 59' for a grease nipple.

Figure 5:
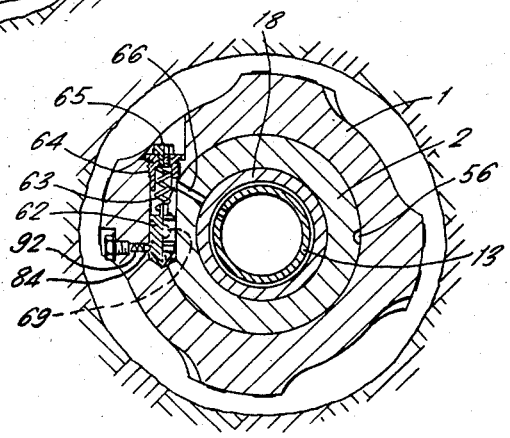
FIG. 5 is a horizontal cross-section along line V—V in FIG. 2.

When running in and drilling (FIG. 5), the shut-off piston 57' is isolated from the pressure inside the tool by the flappervalve sleeve 18 with which is provided O-ring seals (FIG. 2). It is exposed to the pressure inside the tool when in inflating the packer element 54 the flappervalve sleeve 18 is pushed downardly and its friction cam 20 rides over the snapring 17 which then snaps into the slot 21 as will be described later.

The object of the shut-off piston 57' is to close the channel 60 while pump pressure is present within the tool, and to open the channel 60 when the pump is stopped. This is achieved by the pressure within the tool moving the piston 57' against the spring 58 to close the channel 60 from the annulus.

An equalising valve 62 is provided (FIG. 5) which comprises an equalising piston 62, having a conical nose, a helical pressure spring 63 and a threaded bushing 64 in which bolt 65 is screwed.

The purpose of the equalising valve is to open the packer element to the channel 60 when the pressure in the annulus below the packer (which is fed to the valve via channel 66) is exceeded by 300 psi by the mud pressure which is above the packer. The mud pressure is present in channel 60 when piston 57' opens the channel 60 to the annulus.

When a kick is encountered and the packer element 54 has been inflated (FIG. 10) then during circulation through the circulating channels 61 the equalising channel 60 is closed and no extra circulation pressure is behind the equalising piston 62. However when the pump is stopped and the shut-off pistion 57' is pushed back by spring 58 then the equalising channel 60 is open to the mud pressure in the annulus so that the hydrostatic pressure acts on the conical nose of the equalising piston 62. On the opposite side of the equalising piston 62 the formation pressure below the packer is received via equalising port 64 and aligned ports 67 and 68 formed in flappervalve sleeve 18 and snapring sleeve 13 respectively.

Figure 4:
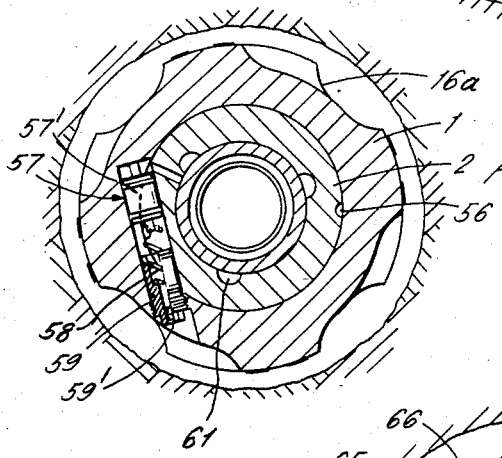
FIG. 4 is a horizontal cross-section along line IV—IV in FIG. 2.

If now the mud weight is sufficiently increased to overbalance the formation porepressure and the pump is stopped then the hydrostatic head of the mud column in the annulus above the packer exerts pressure against the equalising piston 62 and moves this piston until it opens the deflatinq channel 69 so that the pressure inside the packer element escapes into the annulus through equalising channel 60 assisting the equalising piston 62 to remain in open position (FIG. 4).

The overpressure required to move and open the equalising piston 62 can be adjusted by means of the spring loaded ball 84 resting in groove 92 and can be tested with a grease pump having a pressure gauge when the grease nipple is screwed into the thread 57.

When the flappervalve sleeve 18 is pumped down after the packer element has been inflated, the mud below the flappervalve is trapped and, although of very small volume, the closed floatvalve 7 will move downwardly and compress the gas or liquid or squeeze it back into the formation against the formation pore pressure.

Figure 1:
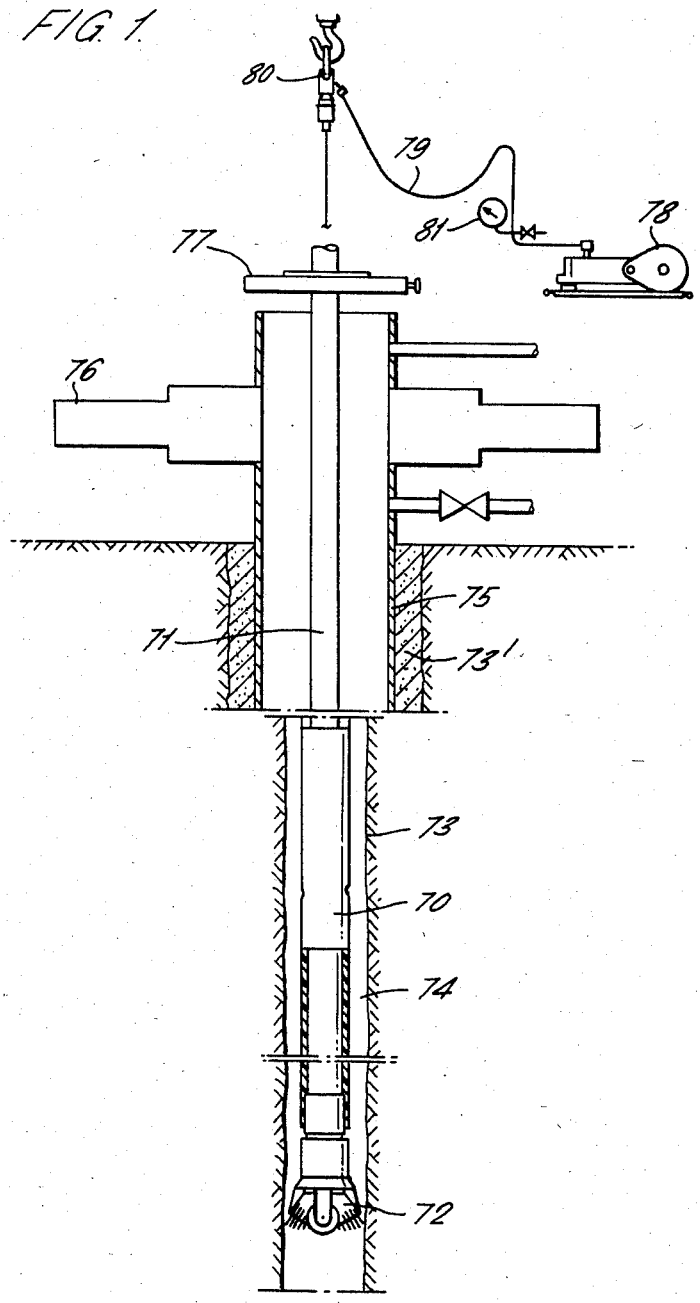
FIG. 1 shows the D.H. BOP connected in a drill pipe-string run into a hole.

After the D.H.BOP is prepared for running in, the D.H.BOP can be run into the hole, so that it reaches eventually the position as shown in FIG. 1. In FIG. 1 is shown the D.H.BOP 70, interconnected between the drillpipe-string 71 and drillbit 72 and run into hole 73 so that annulus 74 is formed. A casing 75 is cemented in the upper portion 73' of the hole 73, while at the surface a surface blow out preventer 76 of known type is provided below rotary table 77. Mud can be pumped by pump 78 through hose 79 and swivel 80 down into drillpipe-string 71, which mud then is ejected from drillbit 72 and flows upwardly through annulus 74. With reference numeral 81 a pressure gauge is shown.

When running in, the drillpipe is empty and the floatvalve 7 is closed and in its highest position (see FIG. 2) so that no mud can enter the drillpipe through the bit nozzles and no formation cuttings can settle down inside the bit on top of the bit nozzles causing the bit to become plugged when circulation is started. The filling of the drillpipe takes place through the fill-up opening 36 and hole 42 of the fill-up gate 41.

The mud is screened by the mudscreen 47. FIGS. 1 and 3 give a clear insight on the operation and position of each valve and part when running into the hole.

Attention should be given to the fact that when for one reason or the other circulation has been established during running into the hole, it will be necessary that the drillpipe will be filled from the top of every stand to be run into the hole because after circulation the fill-up valve will be permanently closed as described herein above.

When the bit has reached the bottom of the hole the mudpumps are started and circulation is established through the floatvalve 7 and the bit nozzles. FIG. 6 gives a clear insight on the operation and position of each valve and part when circulating or drilling. Drilling may continue without encountering a kick and a roundtrip to change the bit is then made without having used the D.H.BOP.

When the bit is pulled and unscrewed, the floatvalve 7, the valve seat inside body 7' and the valve assembly circumferential body seals should be inspected and be in a good condition or changed for new ones before making-up a new bit.

Next, take out the threaded ring 37 from shut-off sleeve 34 with a set and pulling tool, and screw a set and pulling tool into the same thread and pull the shut-off sleeve 34 up until its highest position unscrew tool and screw in threaded ring 37 again.

The fill-up valve gate 41 has to be cleaned and to be reset after each roundtrip. Unscrew locking nut 45, put grease nipple in the thread, pump out the housing 44 for gate piston 43 together with the gate 41, clean and reinsert gate 41 and housing 44, use grease, set gate 41 in fill-up position with a set bolt "s" and screw in locking nut 45, take out set bolt and tighten locking nut 45. The D.H.BOP can be run again and is ready to operate again when necessary.

Figure 8:
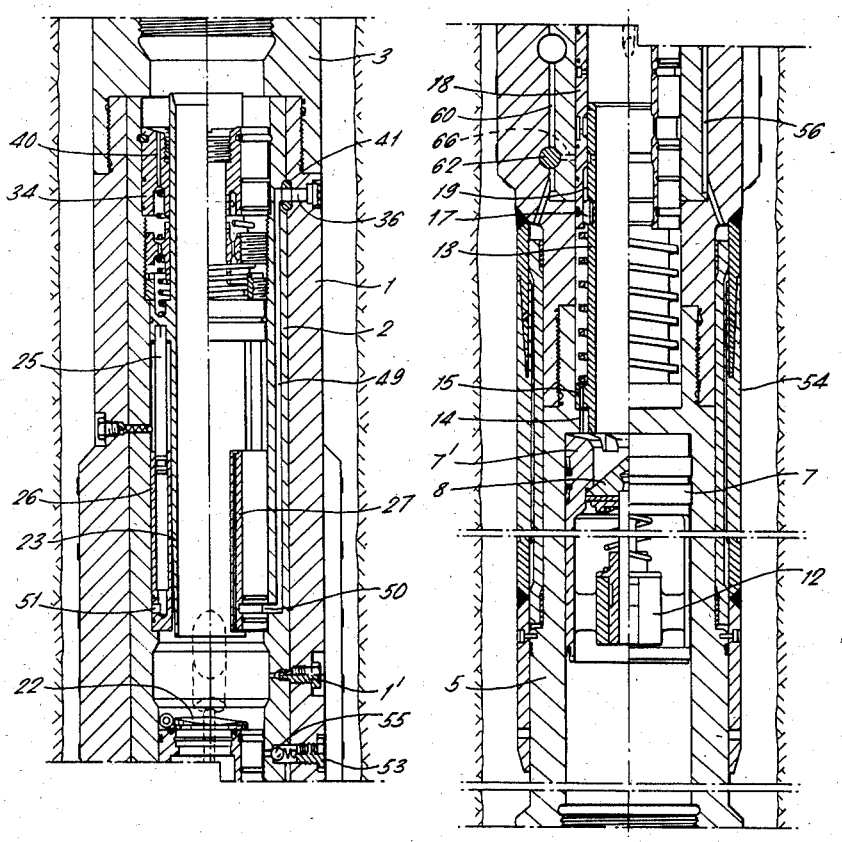
FIG. 8 shows a vertical cross-sectional view of the D.H.BOP during a wellkick after closing the flapper valve.

FIG. 8 gives a clear insight of the operation and the position of each valve and part when a kick is encountered and the annulus is closed in by the surface BOP 76.

If a kick is encountered during drilling then the pumps are stopped, the stand pipe valve closed, the kelly picked-up and the annular BOP closed. The closed-in drill pipe pressure is then read and recorded. As soon as the pumps are stopped the floatvalve 7 will close due to the tension of spring 9.

As the well is completely closed-in, now pressure will be built-up inside the well.

The floatvalve assembly 7 was in its lowest position when circulating. Now the pumps 78 (FIG. 1) are stopped so that the closed floatvalve assembly 7 acts like a floating piston and when pressure below it is building up it can move upwardly making it possible to read the closed in drillpipe pressure (C.I.D.P.P.) from the pressure gauge 81 (FIG. 1).

The C.I.D.P.P. +hydrostatic head of the mud column in the drillpipe =formation pore pressure.

If the kick is observed at an early stage then the time required for the C.I.D.P.P. to build up should be about ten (10) minutes, depending on the column of gas already produced in the annulus 74 (compression).

The C.I.D.P.P. is recored and the required mud weight calculated with sufficient overbalance over the formation pore pressure.

Now the C.I.D.P.P. is slowly bled-off at the drillpipe. Wait a few seconds and start pump 78 slowly.

In the meantime the following occurs downhole: When the well is closed in, the C.I.D.P.P.+hydrostatic head of the mud column in the drillpipe=closed in annular pressure+hydrostatic head of mud column in the annulus because these are communicating vessels with the floating floatvalve assembly 7 between them.

Say that the C.I.D.P.P. is 300 psi. and the pressure is bled-off at the drillpipe, now the annular pressure at the bottom of the hole is 300 psi. higher than in the drillpipe. The floatvalve assembly 7 moves into its highest position and the pressure in the annulus 74 is propagated via the inlet 48 and through hole 42 in fill-up valve gate 41 through the flappervalve release channel 49 underneath the plungers 25, which are then moved upwardly lifting the flappervalve release sleeve 23 until the spring biased flappervalve 22 falls on the seat 18' formed by the upper edge of flappervalve sleeve 18, which is then closed off (see FIG. 8). All above occurs when the C.I.D.P.P. is bled-off at the drillpipe.

Now the pump 78 is started very slowly. Pressure builds up to abt. 1500 pse. and drops. Pump speed is increased to 100–200 gln/min. depending on the size of the D.H.BOP and the size of the circulating channels 59.

Figure 9:
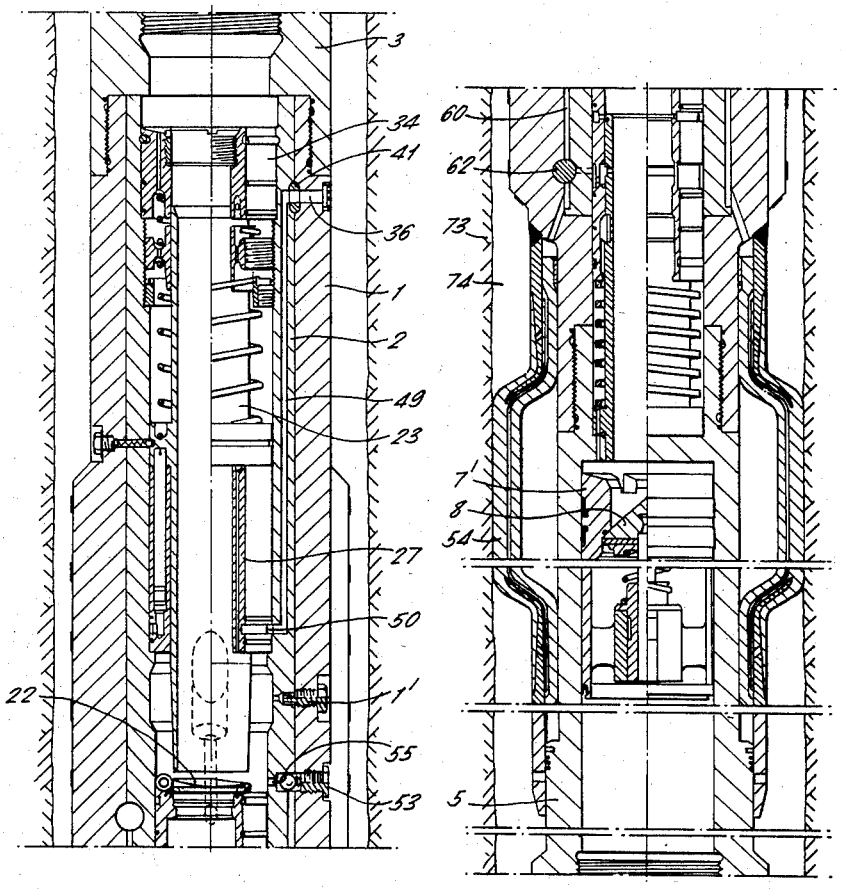
FIG. 9 shows a vertical cross-sectional view of the D.H.BOP, with the packer inflated.

As shown in FIG. 9 downhole the following occurs:

The flappervalve 22 is already closed. Pump 78 runs slowly. The flappervalve sleeve 18 is pushed downwardly by the pump pressure against the helical spring until the inlet 55 of the check valve 53 is uncovered and the flappervalve sleeve 18 hits the snapring 17 with the calibrated friction cam 20. Pressure is now building up and the packer element 54 is inflated through inflation channel 56.

At about 1500 psi. the flappervalve sleeve 18 snaps with its friction cam 20 over the snapring 17 which is locked in the snapring slot 21 and the packer 52 is set.

Figure 10:
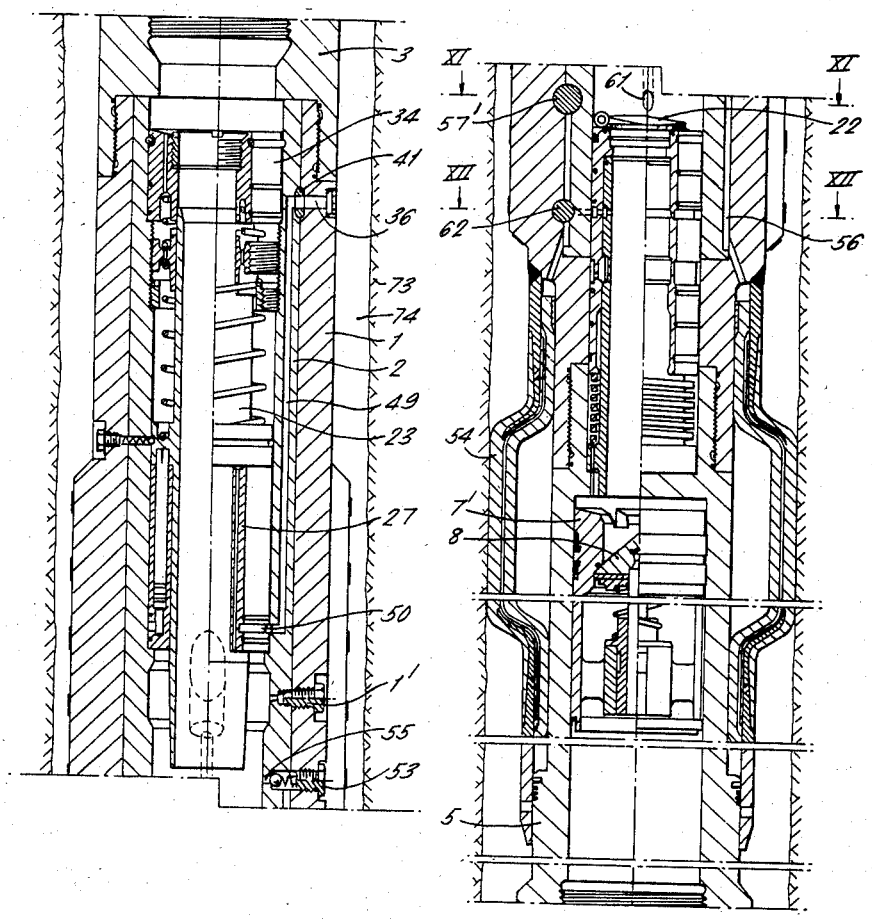
FIG. 10 shows a vertical cross-sectional view of the D.H.BOP, with the circulating port open.

As shown in FIG. 10 when the snapring 17 is snapped into the snapring slot 21 the mud pushes shut-off piston 57' (FIG. 8, 52) outwardly so that piston 57 closes channel 60.

In this position of the sleeve 18 mud can be circulated through the circulation ports 61. When circulation is established the drillstring is lowered to put some weight on the packer to make certain that the packer 54 is set.

The packer 54 is now isolating the producing zone from the remaining portion of the hole.

The tool is closed-off at the bottom by the float valve assembly 7 and from the top by the flappervalve 22.

When the mudweight has been increased by circulation to the required weight so that the hydrostatic pressure of the mud column above the packer 54 is overbalancing the pore pressure of the formation below the packer the pump should be stopped. The channel 60 will then be opened by the piston 57' and the equalizing valve so that the packer is deflated and the string can be pulled out of the hole.

Figure 13:
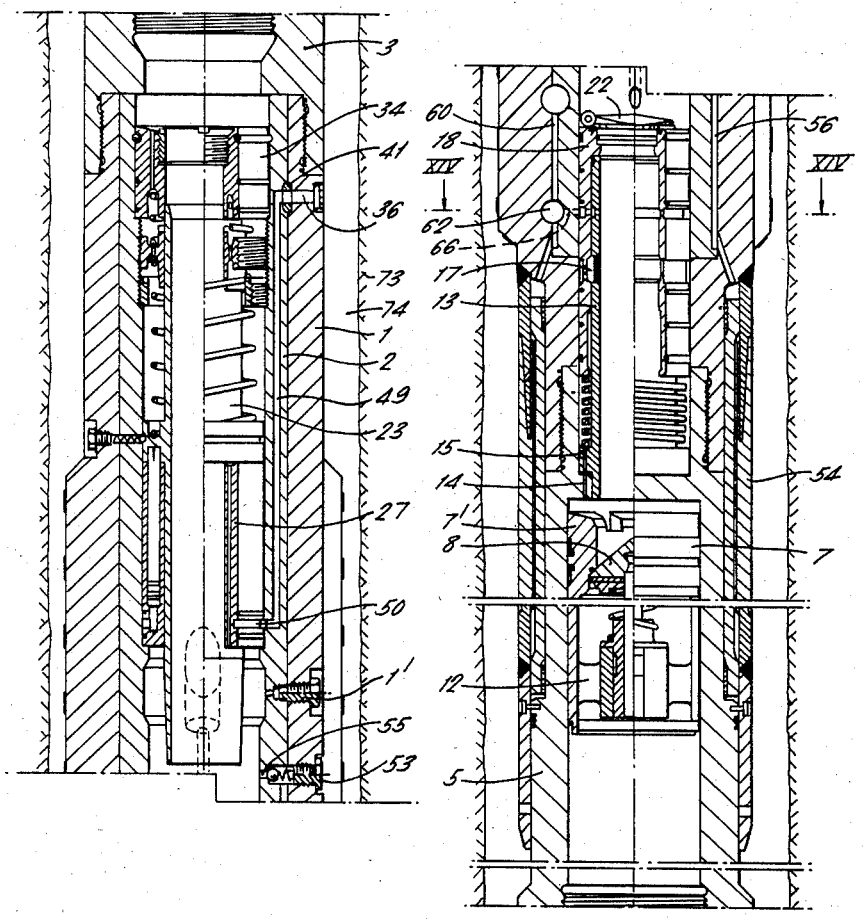
FIG. 13 shows a vertical cross-sectional view of the D.H.BOP, deflating the packer.
Figure 14:
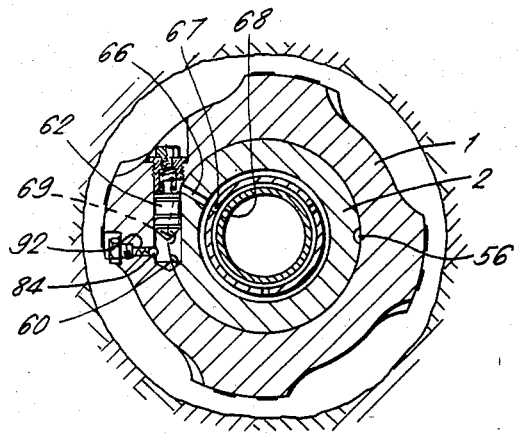
FIG. 14 shows a horizontal cross-section on the line XIV—XIV in FIG. 13.

As shown in FIG. 13 the following occurs downhole when the mud is overbalancing the formation pore pressure and the pump is stopped.

When the pump is stopped the shut-off piston 57 opens the equalising channel 60.

The hydrostatic pressure of the mud column above the packer 54 acts on the one side of the equalising piston 62 which normally shuts off deflating channel 69.

The other side of the equalising piston 62 is connected through channel 66 and ports 67, 68 with the space between the flappervalve 22 and the float valve assembly 7, below which the formation pore pressure acts.

If now the hydrostatic pressure of the mud column in the annulus above the packer 54 overbalances sufficiently the formation pore pressure below the packer then the equalising piston 62 moves and opens the deflating channel 69. The pressure of abt. 1500 psi. behind the packer element 54 is now released in the annulus through channels 69 and 60 and the packer elements deflates and the packer is free.

If the packer does not deflate then the recorded C.I.D.P.P. was not correct and the mudweight should be increased gradually and the pumps stopped at intervals.

When a well starts coming in during roundtripping the same procedure should be followed as during drilling but instead of pulling out continuously one should kill the well, unseat the packer and run back to bottom decreasing the mudweight when going deeper and circulating at intervals.

Circulating takes then place through the circulating ports instead of through the bit nozzles.

When the bottom of the hole is reached, condition the mud and pull-out to inspect all parts of the D.H.BOP.

An alternative use of the D.H.BOP is when drilling on the sea bed with a surface BOP positioned on the sea bed and it is desired to suspend drilling operations e.g. when weather is bad.

The surface BOP is first closed and the mud pressure within the string is bled down. Mud under pressure is then forced into the annulus whereby the pressure in the annulus exceeds the pressure setting of the arresting ball and helical spring in the tool by at least the amount necessary to operate the D.H.BOP to close the flapper valve. The packer element can then be inflated as before and this will seal the bottom end of the casing and the drill string and the surface pipe from the sea bed to the drilling vessel can be removed.

Reconnecting the surface pipe and the drill pipe and releasing the packer can be achieved by closing the drill pipe at the surface and pressurising the annulus, below the closed BOP rams at the surface, to open the equalising valve, whereafter the rams are opened.

An advantage of the DHBOP described is that in addition to controlling a well in a novel manner, a well can be brought under control in the conventional manner. In this case on detecting a kick the surface BOP is closed and the closed in drill pipe pressure is read. Instead of lowering the closed in pressure to close the flapper valve, the closed in pressure is maintained. The flapper valve does not close and the well can be brought under control in the normal way by the introduction of heavier mud.

We claim:

1. A down-hole blow-out preventer capable of operating in conjunction with a surface blow-out preventer, comprising an elongated tubular housing having threaded end portions for connecting the housing in a drillpipe-string and a cricumferentially arranged packer element capable of being inflated outwardly, a valve arranged inside said housing at its lower end, said valve being spring loaded upwardly against a valve seat into its closing position, a flapper valve sleeve received inside said housing in sliding engagement with the housing inner wall and supported at its lower end by spring means, a flapper valve being mounted on its upper end which valve is spring loaded into its closing position in which it is in sealing engagement with the upper rim of the flapper valve sleeve but is retained in its open position by means of a flapper valve release sleeve which is mounted inside said housing for a sliding movement, which flapper valve release sleeve is provided with plunger means having inlet means in communication with the outside of said housing so that by the fluid pressure in the annulus between said housing and the bore hole-wall said plunger means with said flapper valve release sleeve are moved upwardly against the tension of a spring and said flapper valve is released and flaps into its closed position so that by a fluid pressure inside the housing acting on top of the closed flapper valve, the flapper valve sleeve is pushed downwardly into a lower position against said spring means, friction means being provided for holding said flapper valve sleeve in said lower position, while in moving downwardly said flapper valve sleeve uncovers an inlet which is in fluid communication through a check valve with said packer element for inflating said element by said fluid, and in moving over said friction means to a lower most position said flapper valve sleeve uncovers the inlet of a circulation channel which extends through the wall of said housing to the outside, which inlet is closed by a shut-off check valve, means being provided for locking said flapper valve sleeve in its lower most position and means for deflating the packer element.

2. A down-hole blow-out preventer as claimed in claim 1 in which said spring loaded valve at the lower end of said housing is provided inside a floating valve-body which is in sliding engagement with the housing-innerwall so that it is permitted to move between an upper and a lower position.

3. A down-hole blow-out preventer as claimed in claim 1 in which an equalizing device is provided comprising an equalizing piston mounted in a bore closed at both ends and formed in the housing-wall for a sliding movement therein which piston is spring-loaded into the one position near the one end of said bore, a space being present at said one end in which opens a first channel which is in fluid communication with the outside of said housing, while a second channel opens into the bore at a location between said piston in said one position at the other end of the bore, which second channel is in communication with the inside of the flapper valve sleeve through a port which is aligned with said second channel when said flapper valve sleeve is in its lower most position, and a third channel opens into the bore which opening is covered by said piston in said one position but is uncovered when said piston is moved against the tension of the spring to a second position by the fluid pressure acting on said piston through said first channel and said space when this pressure exceeds the spring tension plus the fluid pressure inside the flapper valve sleeve, so that in said second position of said piston said first and third channels are in communication with each other, which third channel forms a deflecting channel and opens at its other end into the packer element.

4. A down-hole blow-out preventer as claimed in claim 3 and in which said first channel has an outlet at its other end which opens into the bore of the shut-off check valve so that in the one position of said valve in which the inlet of the circulation channel is closed, the outlet of the first channel is opened to the outside and in the other position of said valve in which the inlet of the circulation channel is open, said outlet is covered by said valve.

5. A down-hole blow-out preventer as claimed in claim 1 and in which a fill-up channel extends through the wall of said housing near its upper and, a shut-off sleeve being arranged inside said housing for a sliding downward movement against the tension of the spring, which shut-off sleeve in its initial upper most position leaves the inlet of said fill-up channel uncovered but covers said inlet in its lower most position, locking means being provided for locking said shut-off sleeve in its lower most position.

6. A down-hole blow-out preventer as claimed in claim 1 and in which the inlet means of said plunger means which are in communication with the outside of said housing comprises a channel which opens into an inlet which is open to the outside of said housing, a gate member being arranged which is received into a bore formed in the wall of said housing for a sliding movement therein sothat in the one position of said gate member said inlet channel is closed with respect to the outside of said housing and in the other position the inlet is open, a piston member being secured to said gate member of which the end facing away from said gate member bounds a substantially closed space in which opens a channel for communication of said space with the inside of said housing.

7. A down-hole blow-out preventer as claimed in claim 5 and wherein said channel for communication of said space with the inside of said housing opens into said housing at such location that the opening of said channel is covered by said shut-off sleeve in its lower most position.

8. A down-hole blow-out preventer as claimed in claim 7 and wherein said gate member is provided with a hole which is in coaxial alignment with said fill-up channel in the one position of said gate member and in coaxial alignment with said inlet channel in the other position of said gate member.

9. A down-hole blow-out preventer comprising an elongated tubular housing having a through bore for the passage of drilling mud and means for connecting the ends of the housing into a drilling string, a packer element arranged circumferentially around the housing and inflatable into engagement with the bore hole to seal the hole, passage means extending through the housing wall for connecting the bore of the housing with the packer element to inflate the element by mud pressure from within the housing, a cylindrical valve sleeve mounted inside the housing for movement between a drilling position when the sleeve closes said passage means and an inflating position when the passage means is open, a one-way valve for closing the housing bore on the side of the sleeve to be nearer the drill bit, said valve means being operable to allow the passage of mud under pump pressure, but not allowing reverse flow of mud, said valve sleeve providing a through bore for the passage of mud, second valve means for closing the bore in the valve sleeve and means to close said second valve means automatically when pressure in the housing is reduced to a level below the pressure in the bore hole by a predetermined amount, the arrangement being such that after closing of the second valve means the pressure in the housing can be re-applied to urge the valve sleeve to its inflating position allowing the packer element to be inflated, means to prevent closure of the second valve means during running-in, a mud circulation channel extending through the housing on the side of the sleeve valve nearer the surface, means being provided to open said channel when the packer element is inflated whereby mud may be circulated through the drill string, the channel and the bore hole to increase the mud density, and means for deflating the packer element only when the mud density is sufficient to balance the pressure below the packer element.

10. A device as claimed in claim 9 wherein there is means to allow mud to flow through the housing during running in whereby to allow the drill string to be filled during running in.

11. A device as claimed in claim 9 in which the second valve means is biased towards its closed position and there is means to hold the said valve means open which means is releasable on detection of a predetermined pressure difference between the bore hole and the bore of the housing.

12. A device as claimed in claim 11 in which the second valve means comprises a flapper valve member at the upper end of the valve sleeve and the releasable holding means comprises an upper flapper valve sleeve within the housing which sleeve is slidable axially within the housing between a first position in which the flapper valve is held open and a second position in which the flapper valve is released for movement to its closed position.

13. A device as claimed in claim 12 in which the means to move the second sleeve to its second position comprises a piston and cylinder device which is open to the pressure in the bore hole.

14. A device as claimed in claim 9 in which means are provided to retain the valve sleeve in its inflating position and there is means operable when the sleeve is in its inflating position to deflate the packer element when the density of the mud reaches a value sufficient to overcome the pressure at the bore hole below the first valve means.

15. A device as claimed in claim 9 in which there is means to prevent deflation of the packer element when the mud is being circulated.

16. A device as claimed in claim 9 in which the first valve means comprises a valve body which is slidably axially in the housing between end stops and in sealing engagement with the housing whereby the pressure below the first valve means may be measured at the well head.

17. A method of drilling using a surface blow-out preventer in conjunction with a down-hole flow-out preventer connected into a drill string, the down-hole blow-out preventer being of the kind comprising an elongate tubular housing having through bore for the passage of drilling mud and passage means extending through the housing wall, a packer element arranged circumferentially around the housing, its inner space communicating via the passage means in the housing wall with the through bore of the housing, a cylindrical valve sleeve mounted in the through bore of the housing for axial movement between a drilling position when the sleeve closes said passage means and an inflating position when the passage means are open, means for closing the through bore of the housing comprising a one-way valve which is located in the through bore of the housing below the cylindrical valve sleeve and is operable to allow passage of mud under pump pressure through the through bore of the housing in a direction towards the drill bit and is operable automatically to prevent flow of mud in the opposite direction, valve means for closing the bore in the cylindrical valve sleeve, means for holding the valve means open in the course of running in and drilling and for automatically closing said valve means when the pressure in the through bore of the housing is reduced to a level below the pressure in the bore hole by a predetermined amount, a mud circulation channel extending through the housing wall to the through bore of the housing, means being provided to open the mud circulation channel to the through bore of the housing above the cylindrical valve sleeve when the packer element is inflated, and means to allow the packer element to be deflated when the hydrostatic head of the mud column above the packer element is sufficient to overbalance the pressure below it, wherein, on a kick being detected, said method comprises the steps of:

closing the surface blow-out preventer to seal off the bore hole at the surface;

taking at the surface a measurement of the pressure in the bore hole to determine the pressure created by the kick;

letting off at the surface the pressure in the drill string to allow said pressure to fall below the pressure in the bore hole by said predetermined amount whereby to cause said valve means to close;

reapplying the pressure in the drill string whereby to cause said cylindrical valve sleeve to move to its second position allowing inflation of the packer element by mud pressure within the drill string to seal off the bottom of the bore-hole and to cause said means to open the mud circulation channel;

introducing mud of an increased density into the drill string via a valve in the surface blow-out preventer whereby to circulate said mud into the annulus above the packer element via said mud circulation channel; and continuing to circulate said mud until the hydrostatic head of the mud column in the annulus is sufficient to overbalance the pressure of the kick.

* * * * *